United States Patent [19]

Warshawsky

[11] Patent Number: 4,554,620

[45] Date of Patent: Nov. 19, 1985

[54] LAMP AND LAMP ARM

[76] Inventor: Jerome Warshawsky, 1322 Everitt Pl., Hewlett Harbor, N.Y. 11557

[21] Appl. No.: 613,810

[22] Filed: May 25, 1984

[51] Int. Cl.[4] ..... F21V 21/26

[52] U.S. Cl. ..... 362/269; 362/275; 362/285; 362/413; 362/414; 362/419; 362/427; 362/431; 362/432; 248/288.5

[58] Field of Search ..... 362/427, 431, 432, 269, 362/275, 285, 413, 414, 419; 248/288.5

[56] References Cited

U.S. PATENT DOCUMENTS

| | | | |
|---|---|---|---|
| 4,178,625 | 12/1979 | Schudel | 362/431 X |
| 4,347,557 | 8/1982 | Warshawsky | 362/432 X |
| 4,386,393 | 5/1983 | Pike | 362/431 X |
| 4,449,172 | 5/1984 | Warshawsky | 362/427 |
| 4,459,650 | 7/1984 | Pike | 362/427 |
| 4,473,874 | 9/1984 | Warshawsky | 362/432 X |

*Primary Examiner*—Peter A. Nelson
*Attorney, Agent, or Firm*—Stephen E. Feldman

[57] ABSTRACT

A first support arm section is hingedly connected to a second support arm section to form therewith a light source support arm which can be selectively articulated into either an extended or a folded over disposition. A first end of the support arm is formed for connection to a lamp support post and base; while a second end of the support arm is formed to support a light source such as a bulb socket and a lamp shade. The first support arm section and second support arm section are each formed of tubular stock to facilitate electrical wiring and a spring has its ends connected to adjacent hinged portions of the first and second support arm sections to surround hide and protect the electrical wiring and to bias the first and second support arm sections towards each other. In the extended disposition the support arm sections are coaxially aligned and carry a light source so that the illumination is directed downwardly. In the folded over disposition the support arm sections are aligned and parallel to each other and support the light source so that the illumination is directed upwardly. The effects of gravity are sufficient to keep the support arm in either disposition.

26 Claims, 3 Drawing Figures

LAMP AND LAMP ARM

BACKGROUND OF THE INVENTION—FIELD OF APPLICATION

This invention relates to lamps; and more particularly lamps and light supporting arms therefore.

BACKGROUND OF THE INVENTION—DESCRIPTION OF THE PRIOR ART

Many lamps mount their light source in a relatively fixed position, so that the light eminating from the light source illuminates a specific area or location. However, in some instances the light, from the light source, may not provide a desired lighting effect; or if a desired lighting effect is provided only one lighting effect may be possible from a single lamp. Sometimes the desired effect is one providing an area with a subdued lighting that can be obtained by shading the light source towards the floor. During other instances the desired effect may be to bath the area in light by reflecting the light off the ceiling. To provide such changed lighting effects for a given area one may need to obtain and store more than one lamp. Such can be costly and effecting the change by switching one lamp for another may prove to be more bother than its worth. Utilizing a lamp that mounts a number of alternately usable light bulbs, or which mounts a multiple output bulb, will surely provide for varying degrees of lighting for a particular area, but may not help provide for such desired different effects.

In many instances the lamp support (wall bracket, floor base, table base, etc) facilitates the effect to be provided by the lamp. However, many such supports merely serve to mount the light source at a single location and provide a single lighting effect. Some lamp supports, however, by including clutch devices and/or pairs of aligned members that are relatively movable with respect to each other, provide a means of adjusting the height of the light source with respect to the area to be illuminated (floor, desk top, table top, etc). While some change in lighting effect is provided it is not one providing a variation between either lighting a selected relatively small area by direct light, or, alternatively lighting up a relatively larger area as by light reflected off a ceiling. In addition, the clutch mechanism and pairs of support members and the like add to the cost of the lamp. They furthermore are susceptible to relatively significant amounts of wear and when they no longer function properly the lamps use may be greatly diminished.

Some lamps mount the light source within a shade (globe, bullet, or similar member) that serves to contain the light and direct the light in a particular direction and towards a particular area. Thus, a shade may be utilized to direct the light towards the floor or up towards the ceiling. Many such lamps provide a swivel joint to permit moving the shade (and light source) between a number of positions including down towards the floor and up towards the ceiling. However, most available swivel joints include moving parts that are not subject to wear but which must be secured in position once adjusted to a desired location. The action of loosening the securing means, adjusting the swivel and retightening the securing means seems to take its toll on many available lamps. The swivels seem to lose their adjustability and/or the securing means becomes difficult to operate or impossible to tighten. As such the lamp may lose its adjustability, or it may become totally unusable. In addition, the inclusion of such swivels and the attendant securing structure may significantly add to the price of the lamp.

SUMMARY OF THE INVENTION

It is therefore an object of this invention to provide a novel and improved lamp.

It is another object of this invention to provide a novel and improved light support arm for a lamp.

It is yet another object of this invention to provide a novel and improved lamp having a positionable light source.

It is still another object of this invention to provide a novel and improved positionable light support arm for a lamp.

It is yet still another object of this invention to provide a novel and improved lamp having an articulatable light support support arm.

It is a further object of this invention to provide a novel and improved articulatable light support arm for a lamp.

This invention involves lamps having their light source carried by a light source support arm that is, in turn, carried by or mounted to a support member; and contemplates providing the light source support arm with an articulatable joint that enables the light source support arm and light source carried thereby to assume either one of two positions.

Other objects, features, and advantages of the invention in its details of construction and arrangement of parts will be seen from the above, from the following description of the preferred embodiment when considered with the drawings and from the appended claims.

DESCRIPTION OF THE PREFERRED EMBODIMENT

For convenience, the invention will be described as applied to a lamp including a support and base for placing the lamp upon a desk or table, having a light support arm that is fixedly mounted to the vertical support so that it does not rotate with respect thereto and which carries a cone shaped shade for directing the light that is given off by the light bulb. It should be understood, nevertheless, that without departing from the scope of the invention that: the lamp support and base may be sized and of a configuration to mount the light source from a floor position or may include bracket means for mounting the light source on a wall or other vertical member; that the lamp support may be formed to mount the light support arm for selective relative vertical movement to adjust the height thereof; that the light arm may be carried by its support post for selective relative rotation with respect theeto and thus act like a swing arm; and that the lamp shade may be of any convenient configuration.

Figure 1:
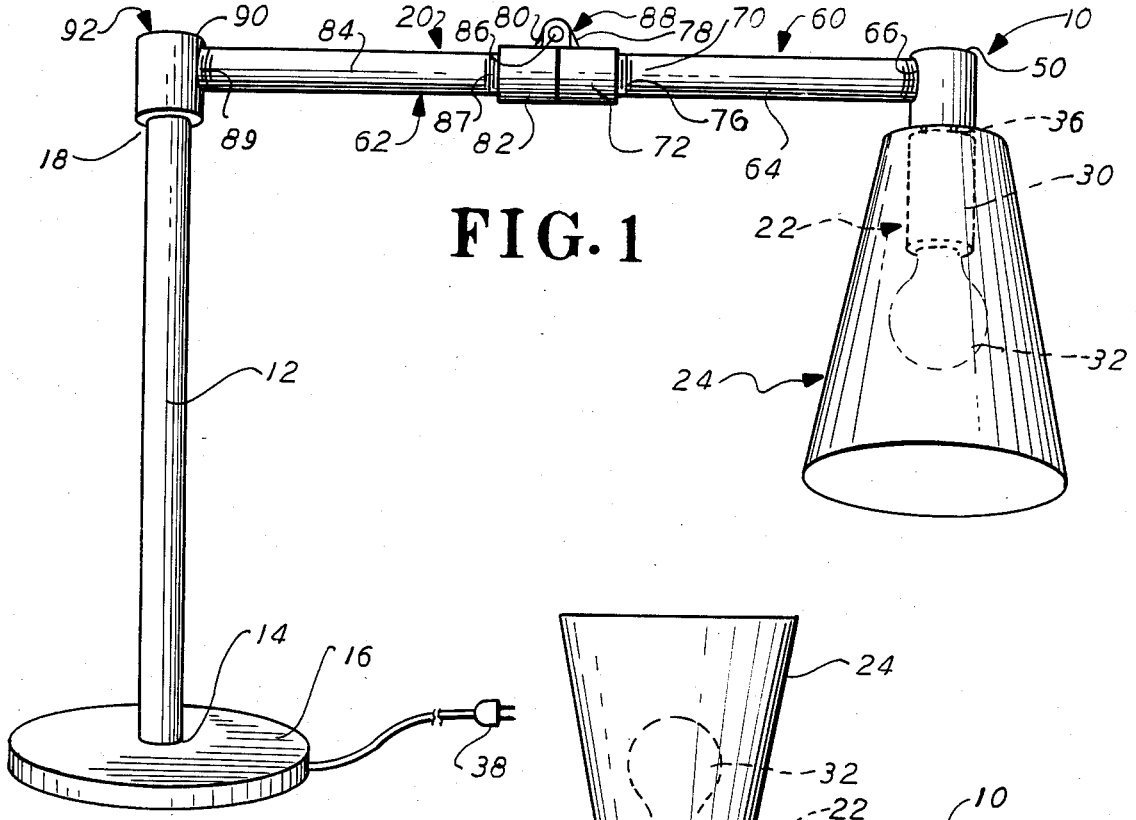
FIG. 1 is a perspective showing of a lamp with a light support arm incorporating the instant invention and showing the light support arm and light source in a first position thereof.
Figure 2:
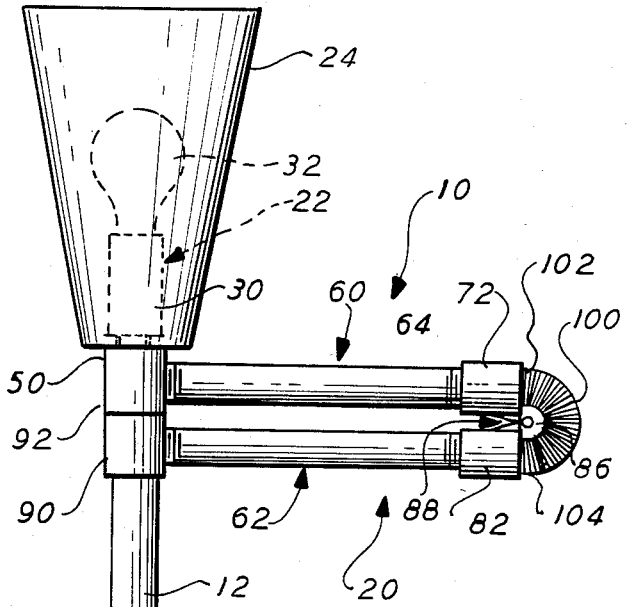
FIG. 2 is a side elevational view of the lamp of FIG. 1 but showing the light support arm and light source in an alternate position thereof.

With reference to FIGS. 1 and 2, there is generally shown at 10 a lamp including a vertically disposed support post 12 the lower end 14 of which is secured to a lamp base 16 and the upper end 18 of which mounts a light support arm 20 which, in turn, carries or mounts a light source 22 and lamp shade 24. Support post 12 is shown as a tubular member formed from metal and of a height sufficient to facilitate disposition of lamp 10 upon a desk, dresser, countertop or the like. Base 16 is connected to post 12 in conventional manner and is also formed of metal and so as to be of circular configuration and otherwise sized and formed to so dispose lamp 10. Support post 12 may however be formed of any convenient material and with any convenient external configuration. Similarly, base 16 may also be formed of any convenient material and of any selected configuration. Support post 12 and base 16 may be otherwise sized and formed to facilitate disposition of lamp 10 on the floor.

Figure 3:
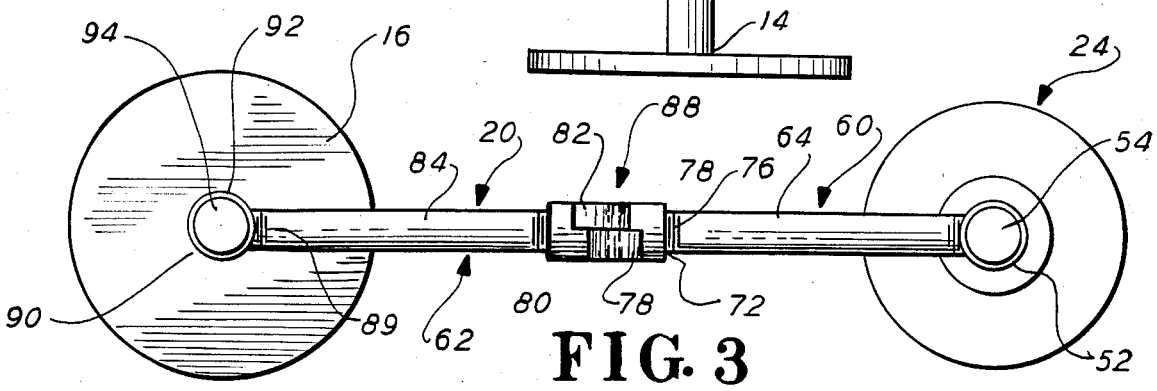
FIG. 3 is a top view of the lamp of FIG. 1.

Light source 22 includes a conventional light bulb socket 30 into which is secured a light bulb 32. Socket 30 may be constructed with conventional chain, twist, push or other type switch means (not shown) for turning light bulb 32 on and off; or it may be of the type permitting light bulb 32 to be turned on and off by a wall switch. Electrical wiring 36 is appropriately connected to light socket 30 and extends therefrom through light support arm 20, support post 12 and base 16 and terminates at a conventional male plug 38 for selective connection to a wall outlet and source of electrical energy. Shade 24 is suitably and conventionally mounted to an end piece 50 of light support arm 20 as by forming end piece 50 with internal threads (not shown) and shade 24 with mating external threads (not shown). End piece 50 is tubular in construction and may be either formed closed at the top 52 (FIG. 3) thereof or closed off at top 52 as by a plug 54.

Light support arm 20 is formed from tubular metal, to facilitate threading of electrical wiring 36 therethrough; and includes a first section 60 and a second section 62 which are substantially identical. Section 60 includes a tubular member 64 which has a first end 66 secured to end 50 as by forming external threads on end 66 and mating internal threads in a suitable opening formed in end 50. A second end 70 of tubular member 64 carries a hinge end 72 appropriately secured to member 64 as by forming external threads 76 on end 70 of member 64 and mating internal threads (not shown) within hinge end 72. A first hinge half 78 is formed on hinge end 72 for mating engagement with a second hinge half 80 formed on a hinge end 82 carried by a tubular member 84 of second section 62. A hinge pin 86 extends through openings suitably formed through hinge halfs 78, 80 to pivotally connect hinge halfs 78, 80 and sections 60, 62 to each other. Hinge ends 72, 82 and hinge pin 86 together form a hinge 88 or articulation joint or means for light support arm 20.

Tubular member 84 is formed similar to tubular member 64 and is secured to hinge end 82 as by having external threads 86 formed at one end thereof for mating engagement with internal threads formed within hinge end 82. The opposite end 88 of member 84 is connected to a mounting end piece 90 as by forming external threads on end 88 and mating internal threads on end piece 90. End piece 90, like end piece 50 is formed of tubular material and either closed at a top 92 thereof or so as to be closed off by a plug 94 or the like. End piece 90 is otherwise formed to be secured to the top of support post 12 to facilitate mounting light support arm 20 and light source 22 thereto.

A spring member 100 (FIG. 2) has a first one of its ends 102 secured within hinge end 72 of first section 60, and a second one of its ends 104 secured within hinge end 82 of second section 62. Spring member 100 is tubular and receives therethrough electrical wiring 36 to protect same and provide an enclosure for wiring 36 when support arm 20 is in its folded over disposition of FIG. 2. Spring member 100 is compressed and enclosed within hinge ends 72, 82 when lamp support arm 20 is in its extended disposition of FIGS. 1 and 3. Spring member 100 may, or may not, bias fist section 60 and second section 62 into the extended disposition of support arm 20 depending upon the particular size of the members selected therefore.

The construction of light support arm 20 in two sections 60, 62, and the connection of sections 60, 62 by a hinge 88 enables light support arm 20, light source 22 and shade 24 to be selectively positioned in either a first or extended disposition (FIGS. 1 and 3) or a second or folded over disposition (FIG. 2). Movement of light support arm 20, light source 22 and shade 24 between said first disposition and said second disposition is accomplished by merely rotating first section 60 about hinge 88 either in a clockwise direction (FIG. 1) to move first section 60 from its extended disposition to its folded over disposition, or in a counterclockwise direction (FIG. 2) to move first section 60 from its folded over disposition to its extended disposition.

In the extended disposition for lamp 10 light source 22 and light bulb 32 face downwardly. Shade 24 also faces downwardly and directs the illumination from light source 22 downwardly to provide a first effect such as that of shaded soft lighting. The weight of first section 60, light bulb socket 30, light bulb 32 and shade 24 maintain support arm 20 in its extended (FIGS. 1 and 3) disposition. Spring member 100 may assist in urging swing arm 20 to maintain its extended disposition.

In the folded over disposition (FIG. 2) for lamp 10 light source 22 and light bulb 32 face upwardly. Shade 24 also faces upwardly and directs illumination from light source 22 upwardly to provide a second effect such as that of light reflected off a ceiling to light up a selected area. Here again the weight of first section 60, light bulb socket 30, light bulb 32 and shade 24 maintain support arm 20 in its folded over disposition (FIG. 2). Spring member 100 is selected so that while extended it does not offset the weight of the enumerated elements and move support arm 20 out of its folded over disposition.

The configuration of end pieces 50 and 90, of tops 52 and 92 thereof and of plugs 54 and 94 thereof facilitate the folded over disposition of support arm 20 and the positioning of end piece 50 of first section 60 upon end piece 90 of second section 62.

From the above description it will thus be seen that there has been provided a lamp, and a light source support arm for a lamp, which by a relatively simple and efficient construction provides for movement of the light source between two selected dispositions.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

What is claimed is:

1. A support arm for the light source of a lamp comprising:

(a) first support arm section means;

(b) second support arm section means;

(c) articulation means connecting said first support arm section means and said second support arm section means so as to enable said support arm, and a light source when carried thereby to assume either one of only two selected dispositions;

(d) said articulation means including hinge means enabling movement of said first support arm section and said second support arm section one with respect to the other about said hinge means, and disposition of said first support arm section and said second support arm section, one with respect to the other, into said either one of said only two selected dispositions.

2. The lamp of claim 1, wherein said support means includes a support post and base.

3. The lamp of claim 2, wherein said support post and base are sized and of a configuration to mount said light source means upon a table or the like.

4. The lamp of claim 1, wherein said light source means includes a shade.

5. The support arm of claim 1 wherein said articulation means also includes flexible means connecting said first support arm section and said second support arm section and facilitating said disposition of one with respect to the other.

6. The lamp of claim 1, wherein said first section includes a post of predetermined length having a first end connected to said articulation means and a second end connected to said light source means.

7. The lamp of claim 6, wherein said post is of hollow tubular construction.

8. The lamp of claim 6, wherein said second section includes a post of predetermined length having a first end connected to said articulation means and a second end connected to said support means to mount said support arm means and light source means carried thereby to said support means.

9. The lamp of claim 8, wherein said post of said second section is of hollow tubular construction.

10. The lamp of claim 8, wherein said first section and said second section are of identical size.

11. The lamp of claim 10, wherein in said first selected disposition of said support arm means said first section thereof and said second section thereof are co-axially aligned.

12. The lamp of claim 11, wherein in said first selected disposition of said support arm means said light source means directs illumination downwardly.

13. The lamp of claim 10, wherein in said second selected disposition of said support arm means said first section thereof and said second section thereof are folded over one with respect to the other with their respective posts aligned and parallel one to the other.

14. The lamp of claim 13, wherein in said second selected disposition of said support arm means said light source means directs illumination upwardly.

15. The lamp of claim 13, wherein in said second selected disposition of said support arm means at least a portion of said first section rests upon and is supported in part by at least a portion of said second section.

16. The support arm of claim 1, wherein said first support arm section means includes a post of predetermined length having a first end connected to said articulation means and a second end adapted to be connected to a light source; and said second support arm section means includes a post of predetermined length having a first end connected to said articulation means and a second end adapted to be connected to a support for mounting the support arm.

17. The support arm of claim 1, wherein said post of said first support arm section and said post of said second support arm section are formed from tubular material.

18. The support arm of claim 16, wherein said post of said first support arm section and said post of said second support arm section are substantially identical in length.

19. The support arm of claim 17, wherein in said first selected disposition said first support arm means and said second support arm means are co-axially aligned.

20. The support arm of claim 17, wherein in said second selected disposition said first support arm means and said second support arm means are folded over once with respect to each other with their respective posts aligned and parallel one to the other.

21. The support arm of claim 19, wherein in said second disposition at least a portion of said second support arm means is formed to rest upon and be supported by at least a portion of said first support arm means.

22. A lamp comprising:

(a) support means;

(b) light source means;

(c) support arm means carrying said light source means and connected to said support means;

(d) said support arm means including a first section and a second section interconnected one to the other by articulation means;

(e) said articulation means including hinge means enabling movement of said first section and said second section one with respect to the other about said hinge means, and disposition of said first section and said second section, one with respect to the other into either one of only two selected dispositions;

(f) the gravitational effect due to the weight of said light source means and of at least one of said sections of said support arm means facilitating the disposition of said light source means in either of said two selected dispositions.

23. The lamp claim 22 wherein articulation means also includes flexible means connecting said first section and said second section and facilitating said disposition of one with respect to the other.

24. The lamp of claim 23 wherein said hinge means includes a first hinge half carried by said first section and a second hinge half carried by said second section and a hinge pin connecting said first hinge half and said second hinge half.

25. The support arm of claim 5 wherein said flexible means constitutes a flexible tubular spring.

26. The support arm of claim 5 wherein said hinge means includes a first hinge half carried by said first support arm section and a second hinge half carried by said second support arm section and a hinge pin connecting said first hinge hald and said second hinge half.

* * * * *